US005210953A

United States Patent [19]

Small

[11] Patent Number: 5,210,953

[45] Date of Patent: May 18, 1993

[54] DURABLE SIGHT SYSTEM FOR A FIREARM

[76] Inventor: Roger E. Small, 178 Second Ave. North, Nashville, Tenn. 37201

[21] Appl. No.: 755,751

[22] Filed: Sep. 6, 1991

[51] Int. Cl.[5] ..... F41G 1/22

[52] U.S. Cl. ..... 33/258; 33/257; 33/252

[58] Field of Search ..... 33/233, 252, 254, 256, 33/257, 258, 259, 260, 244

[56] References Cited

U.S. PATENT DOCUMENTS

| | | | |
|---|---|---|---|
| 1,618,749 | 2/1927 | Blizard | 33/259 |
| 2,127,565 | 8/1938 | King et al. | 33/257 |
| 2,473,891 | 6/1949 | Lillard | 33/254 |
| 2,511,245 | 6/1950 | Caster | 33/258 |
| 2,781,583 | 2/1957 | Grimble | 33/233 |

*Primary Examiner*—Thomas B. Will
*Attorney, Agent, or Firm*—Edward D. Lanquist, Jr.; Mark J. Patterson; I. C. Waddey, Jr.

[57] ABSTRACT

The present invention discloses a durable sight system. The front sight portion of this invention relates generally to a durable front sight which attaches to the barrel of a firearm over the existing front sight. The new front sight has a cutout which receives and surrounds the exposed portions of the existing front sight of the firearm. The front sight has a base and a blade. The rear sight has an aperture platform which rests upon the upper side of a sight base and a lock plate which resides in and is bounded by a lock plate encapsulator. The under side of the aperture platform has ridges which engage corresponding ridges on the upper side of the sight base. A screw passes through adjustment orifice of aperture platform, and engages threaded hole in lock plate bar and lock plate. Bar is received by lock plate orifice and lock plate is received by lock plate encapsulator. The base of the rear sight has holes in it to receive screws which are used to attach rear sight to the receiver of a firearm. When screw is loosened to allow windage adjustments, lock plate encapsulator prevents lock plate from moving too far and base orifice prevents bar from moving too far.

3 Claims, 3 Drawing Sheets

DURABLE SIGHT SYSTEM FOR A FIREARM

BACKGROUND OF THE INVENTION

The present invention relates generally to a durable sight system for a firearm and more particularly to a durable front sight which will mount over an existing front sight and a durable rear sight which uses a single screw for adjusting for windage and elevation.

It will be appreciated by those skilled in the art that firearms have sights. It will be further appreciated by those skilled in the art that firearms used in law enforcement and in the military must be durable. It will further be appreciated by those skilled in the art that projectiles fired from a firearm are affected by the variables of both gravity and wind. Therefore, firearms must have a sight system which can be adjusted to compensate for the variables of gravity and wind and whose adjustments are not be affected by firearm droppage. To this end, there have been several attempts to provide both a durable and easily adjusted sight system.

Currently on the market, there are several rear sights which are made from various alloys and which adjust for windage and elevation. However, each of these rear sights requires one adjustment mechanism for elevation and another adjustment mechanism for windage. These two-step sight adjustments are readily affected by the wear and tear exerted on a firearm and can be cumbersome at inopportune times.

There have been several attempts to remove and replace the front sight of a firearm. Unfortunately, these attempts require the removal of the entire front sight, so that a new sight can be used in its place. The removal of the front sight is time consuming and can damage the barrel and the front sight. Further, should the user wish to again use the original front sight, he would have to replace the removed existing front sight.

What is needed, then, is a durable front and rear sight system for a firearm. The front sight of this durable sight system must be capable of being placed over the firearm's existing front sight. The placement of this front sight must be easily and quickly performed without the need for special processes. The complex windage and elevation adjustments for the rear sight must be performable with one step. The adjustments should not change if the firearm is dropped or bumped. This durable sight system is presently lacking in the prior art.

SUMMARY OF THE INVENTION

The present invention relates to a front and rear sight system that can be used together or independently. The rear sight has an aperture platform which rests upon the upper side of a sight base and a lock plate which resides in and is bounded by a lock plate encapsulator. The under side of the aperture platform has ridges which engage corresponding ridges on the upper side of the sight base. A screw passes through adjustment orifice of aperture platform from upper side to lower side and engages threaded hole in lock plate bar and lock plate. Bar is received by lock plate orifice and lock plate is received by lock plate encapsulator. The base of the rear sight has holes in it to receive screws which are used to attach rear sight to the receiver of a firearm.

When adjustment screw is tight, aperture platform is very difficult to move. If adjustment screw is loosened slightly, aperture platform can be moved side to side for windage adjustment. If the screw is loosened more, the platform ridges and the base ridges become sufficiently disengaged so that the user can adjust for elevation by moving aperture platform forward or backward. In the preferred embodiment, when screw is loosened to allow windage adjustments, lock plate encapsulator prevents lock plate from moving too far and base orifice prevents bar from moving too far.

The front sight portion of this invention relates generally to a durable front sight which attaches to the barrel of a firearm over the existing front sight. The new front sight has a cutout which receives and surrounds the exposed portions of the existing front sight of the firearm. The front sight has a base and a blade.

Accordingly, one object of the present invention is to provide a durable sight system.

Still another object of the present invention is to provide a front sight which may be placed over the existing sight of a firearm.

Still another object of the present invention is to provide a sight system which is easy to install and which can be installed very quickly.

Still another object of the present invention is to provide a rear sight which can have a windage and elevation adjustment made by one step.

DESCRIPTION OF THE PREFERRED EMBODIMENT

Figure 1:
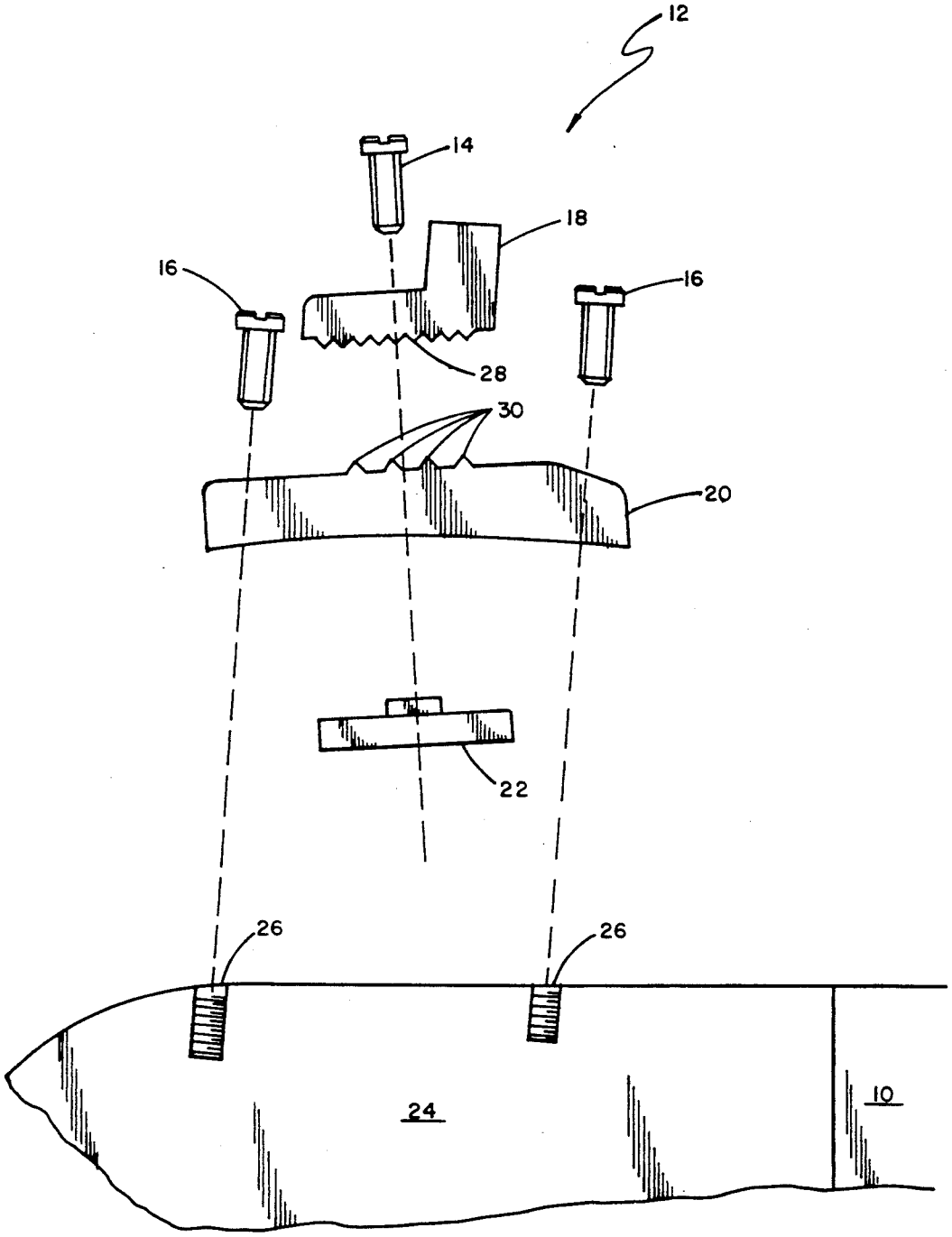
FIG. 1 is an exploded view of the rear sight of the present invention.

Referring now to FIG. 1, there is shown generally at 12 the durable rear sight of the present invention. As can be seen, holes 26 are drilled into receiver 24 of firearm 10. After holes 26 are drilled, holes 26 are tapped. Adjustment screw 14 passes through aperture platform 18, through sight base 20 and is received by lock plate 22. As screw 14 is tightened into lock plate 22, platform ridges 28 engage base ridges 30 until aperture platform 18 cannot be moved to the right and left of sight base 20, in relation to the view shown in FIG. 1. However, aperture platform 18 can move from side to side with respect to sight base z into the view and out of the view shown in FIG. 1. Adjustment of aperture platform 18 to the right and left of sight base 20 in the view shown in FIG. 1 adjusts elevation; whereas, the movement of aperture platform 18 into and out of the view shown in FIG. 1 is an adjustment for windage. Attachment screws 16 then pass through sight base 20 and into mounting holes 26. Screw 14 passes through adjustment orifice 42 of aperture platform is from upper side to lower side and engages threaded hole 32 in lock plate bar 62 and lock plate 22. Bar 62 is received by lock plate orifice 34 and lock plate 22 is received by lock plate encapsulator 60.

Figure 2:
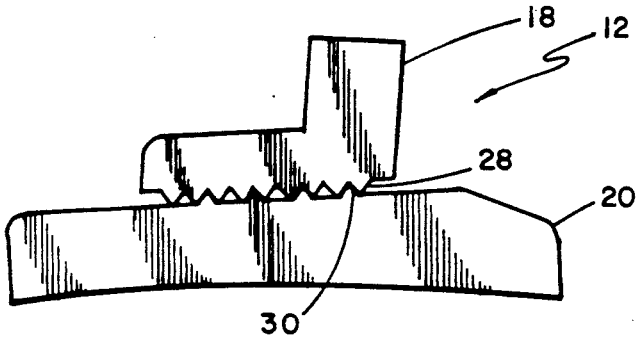
FIG. 2 is a side view of the rear sight of the present invention.

Referring now to FIG. 2, there is shown generally at 12 a side view of the rear sight system of the present invention. As can be seen, platform ridges 28 of aperture platform 18 engage base ridges 30 of sight base 20.

Figure 3:
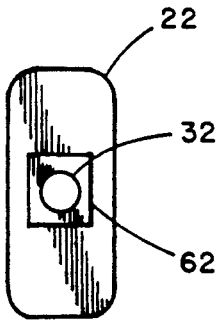
FIG. 3 is a plan view of the lock plate of the present invention.
Figure 4A:
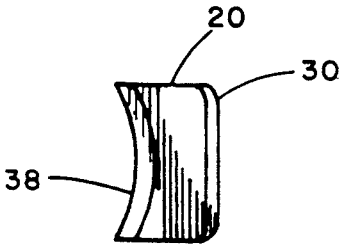
FIGS. 4*a–d* are views of the sight base for the rear sight of the present invention.
Figure 4B:
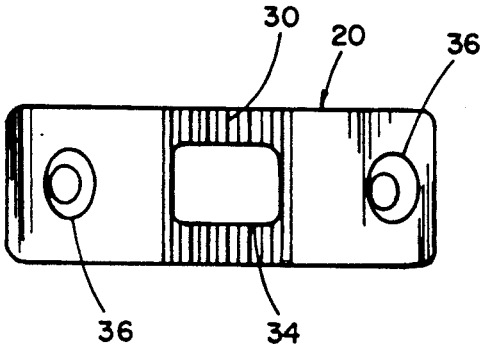
Figure 4C:
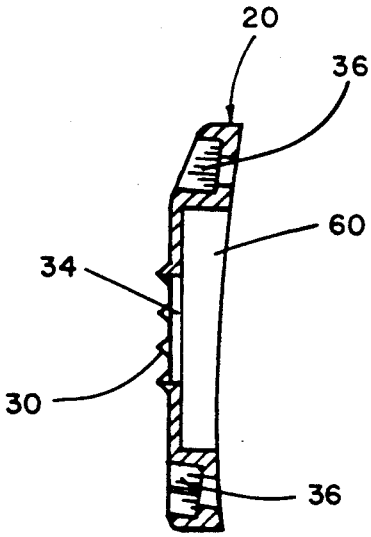
Figure 4D:
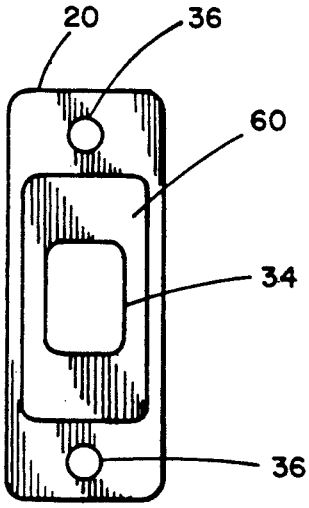

Referring now to FIG. 3, there is shown generally at 22 a plan view of the lock plate of the present invention. Lock plate orifice 32 receives adjustment screw (14 in FIG. 1).

Referring now to FIGS. 4*a–d*, there is shown generally at 20 the sight base of the present invention. Sight base 20 has ridges which engage platform ridges (28 in FIGS. 1 and 2). Mounting screws 16 pass through mounting orifices 36 prior to passing into mounting holes (26 in FIG. 1). Base orifice 34 receives bar 62 and is of sufficient size to enable bar 62 to be moved forward and backward as well as left in right for adjustment for windage and/or elevation. Bar threadibly receives screw 14. Lock plate encapsulator 60 is an orifice formed in base to receive lock plate (22 in FIG. 1) and is of sufficient size to allow lock plate 22 in FIG. 1) to float until lock plate (22 in FIG. 1) is frictionally held by screw 14 against base 20. Markings may be placed on base 20 or other portion of sight 12 for given distances and wind velocities. Lock plate 22 has bar 62 which moves and is received by orifice 34 in such a manner as to allow bar 62 to float until screw 14 locks plate 22 in place. Bar 62 and lock plate 22 threadibly receive screw 14 in lock plate orifice 32.

Figure 5A:
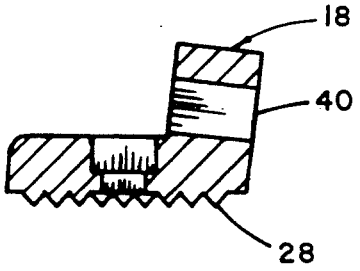
FIGS. 5*a*, 5*b*, and 5*c* are different views of the aperture platform of the present invention.
Figure 5B:
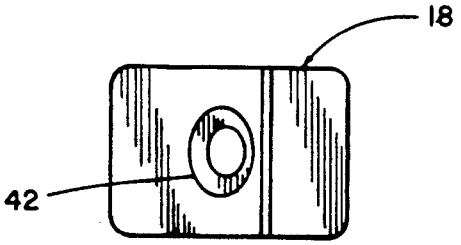
Figure 5C:
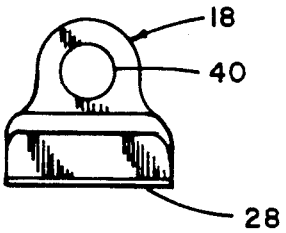

Referring now to FIGS. 5*a*, 5*b*, and 5*c*, there is shown generally at 18 various views of the aperture platform of the present invention. As can be seen, aperture platform 18 has platform ridges 28 which engage base ridges (30 in FIG. 1). Adjustment screw (14 in FIG. 1) passes through adjustment orifice 42, and threads into lock plate (22 in FIG. 1). Sight aperture 40 is part of or attached to aperture platform 18. User would look through sight aperture 40 to aim firearm.

Figure 6:
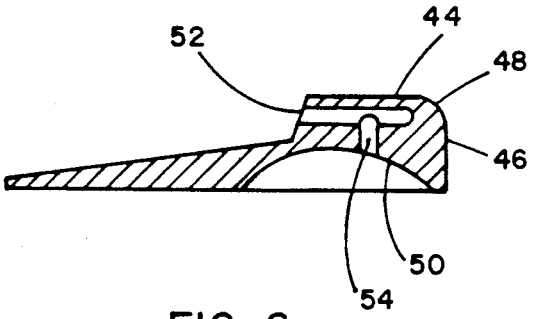
FIG. 6 is a side view of the front sight of the present invention.

Referring now to FIG. 6, there is shown generally at 44 the front sight of the present invention. In this particular embodiment, a ramp-type front sight is used. However, virtually any type of front sight can be utilized in the present technology. Front sight 44 has blade 48 and base 46. Base 46 has cutout 50 placed into it to receive existing sight (58 in FIG. 8). Front sight 44 may also have insert hole 52 for placement of self-luminous element.

Figure 7:
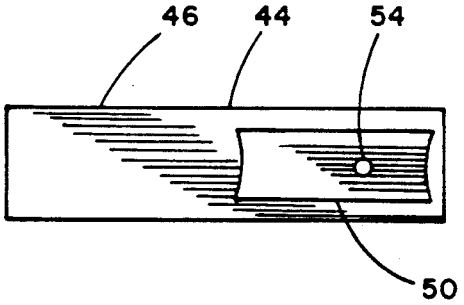
FIG. 7 is a view of the underside of the front sight of the present invention.

Referring now to FIG. 7, there is shown generally at 44 another view of the front sight present invention. As can be seen in this view, cutout 50 is centered on base 46. Bleed hole 54 is provided to intersect insert hole (52 in FIG. 6).

Figure 8:
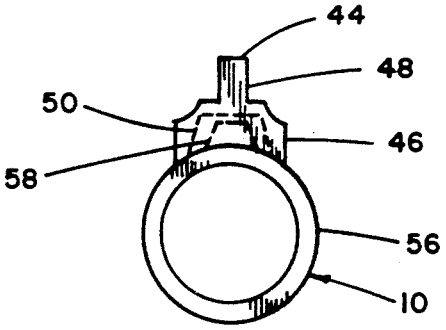
FIG. 8 is a frontal view of the front side of the present invention.

Referring now to FIG. 8, there is shown generally at 44 still another embodiment of the present invention. In this view, cutout 50 surrounds existing sight 58. Further, in this view, front sight 44 attaches to barrel 56 of firearm 10.

In the preferred embodiment, both rear sight 12 and front sight 44 have an arcuately shaped base to fit a standard firearm. However, if the firearm is square, heptagonal, octagonal, or any other shape, the base can be shaped accordingly.

In the preferred embodiment, screws 14, 16 are 6–40 screws.

Part of the existing sight $s may be removed to allow cutout 50 to be smaller. However, cutout 50 can be of sufficient size to cover entire front sight 58.

In the preferred embodiment, adjustment screw 16 is a slotted screw. However, the type of screw head is not important.

In the preferred embodiment, front sight 44 is attached by using adhesive. In the preferred embodiment, adhesive is a 3M® epoxy. Prior to placement of the adhesive, the front sight and barrel should be degreased. In the preferred embodiment, adhesive is applied to base 46 of front sight 44. Front sight 44 is then placed on barrel 56 and held in place by a Vice-grip® brand pliers.

The sight system of the present invention can be used on any type of firearm including, but not limited to, shotguns, rifles, handguns, muskets and the like. In the preferred embodiment, the sight system is placed on a shotgun.

Thus, although there have been described particular embodiments of the present invention of a new and useful "Durable Sight System for a Firearm", it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A rear sight for a firearm having a receiver, said rear sight comprising:

a. a sight base having a top side and a bottom side, said top side having plural base ridges, said base having a base orifice proximate to said top side and an encapsulator proximate to said bottom side;

b. means for attaching said sight base to said firearm;

c. an aperture platform placeable on said top side of said base, said aperture platform having an upper side and a lower side, said lower side having plural platform ridges mateable with said plural base ridges, said aperture platform having an adjustment orifice;

d. a lock plate having a threaded orifice, said lock plate receivable by said encapsulator;

e. an adjustment screw received by said adjustment orifice, said base orifice, and said threaded orifice, respectively such that said screw is receivable by said threaded orifice and to provide a single step to achieve omni-directional adjustment for elevation and windage.

2. The device of claim 1 wherein said lock plate having a lock plate bar receivable by said base orifice.

3. The system of claim 2 further comprising said bottom side shaped to reside on said receiver.

* * * * *